US005150591A

United States Patent [19]

Norden, Jr.

[11] Patent Number: 5,150,591

[45] Date of Patent: Sep. 29, 1992

[54] NORDEN DOUBLE DOOR LOCK

[76] Inventor: Howard P. Norden, Jr., 3 Crest Hill Pl., Smithtown, N.Y. 11787

[21] Appl. No.: 674,108

[22] Filed: Mar. 25, 1991

[51] Int. Cl.[5] ..... E05B 65/06

[52] U.S. Cl. ..... 70/129; 292/148; 292/DIG. 60; 292/DIG. 73; 70/DIG. 65; 70/212

[58] Field of Search ..... 292/DIG. 21, 143, 148, 292/259, DIG. 56, DIG. 60, DIG. 73; 70/461, 129, DIG. 65, 212

[56] References Cited

U.S. PATENT DOCUMENTS

| | | | |
|---|---|---|---|
| 1,047,315 | 12/1912 | Shone | 292/148 |
| 1,222,462 | 4/1917 | Pindroh | 292/DIG. 21 |
| 3,656,788 | 4/1972 | Emery | 292/259 R |
| 3,819,216 | 6/1974 | Richardson | 292/259 R |
| 4,512,105 | 4/1985 | Norton | 292/148 |
| 4,524,590 | 6/1985 | Budish | 292/DIG. 21 |
| 4,529,235 | 7/1985 | Florentine, Sr. | 292/259 R |
| 4,796,445 | 1/1989 | Nolden, Jr. | 70/94 |
| 5,014,527 | 5/1991 | Traller et al. | 292/259 R |

FOREIGN PATENT DOCUMENTS

| | | | |
|---|---|---|---|
| 853639 | 12/1939 | France | 292/148 |

*Primary Examiner*—Renee S. Luebke
*Assistant Examiner*—D. Boucher
*Attorney, Agent, or Firm*—Galgano & Belkin

[57] ABSTRACT

A door locking mechanism for use on the inside of a pair of outswinging doors mounted in the opening of a frame in which the doors are hinged at opposite edges and having free edges adjacent each other and free to be moved between the opening and closing of the doors. The mechanism comprises extended members U-shaped in cross section mounted on the doors. One end terminates substantially flush with the free edge of each door. A latch plate is mounted for sliding movement within one U-shaped member. The latch plate is provided with a handle extending through a slot in the U-shaped member which can be employed to move the latch plate. The latch plate is moved between a closed position wherein the latch plate extends past the free edges of the doors to overlap the second door and an open position where the plate is entirely within the width of the first door. A lever is provided to clamp or unclamp the latch plate in either the open or closed positions. The second extended U-shaped member mounted on the second door receives the latch plate in the closed position. Provision is made to lock the latch plate in both the closed and open positions of the latch plate.

5 Claims, 3 Drawing Sheets

NORDEN DOUBLE DOOR LOCK

BACKGROUND OF THE INVENTION

The present invention relates to a door locking mechanism and more particularly to a door locking mechanism for use on the inside of outwardly opening double doors.

Commercial establishments require door locking mechanisms with improved ability to withstand attempts at unlawful entry, while at the same time capable of being used as an emergency exit in case of fire.

In my U.S. Pat. No. 4,796,445 issued on Jan. 10, 1989, I show a door locking mechanism for use on an outswinging exit door capable of being locked in either the open or closed position, preventing for example, someone from intentionally or inadvertently locking the door when it should be available for an emergency exit.

The locking mechanism shown in my patent is not suitable or capable of use with double doors which are so commonly in use in commercial buildings, especially where large crowds of people are expected to congregate, for example, in auditoriums. In many such situations only one of the two doors may be in use so that any locking mechanism being utilized in such a situation should be capable of accomodating this type of action.

SUMMARY OF THE INVENTION

This invention is designed to provide locking for outswinging double doors in both the closed and unclosed condition using a simple and inexpensive construction while at the same time dependable and highly effective.

A preferred embodiment of this invention comprises a door locking mechanism for being mounted on the inside of a pair of outswinging doors. The mechanism consists of a separate housing for each door. One housing is provided with a slidable member with a protruding handle for moving said member into the adjoining housing to prevent either door from being opened. Provision is made to lock the slidable member against being retracted. When the slidable member is retracted to permit the doors to be opened, provision is included to permit the slidable member to be locked into that position. In addition, lever handles are provided to prevent rattling of the slidable member in either position.

It is thus a principal object of this invention to provide a locking mechanism for the use on the inside of a pair of outswinging doors.

Other objects and advantages of this invention will hereinafter become obvious from the following description of preferred embodiments of this invention.

DESCRIPTION OF THE PREFERRED EMBODIMENT

Figure 1:
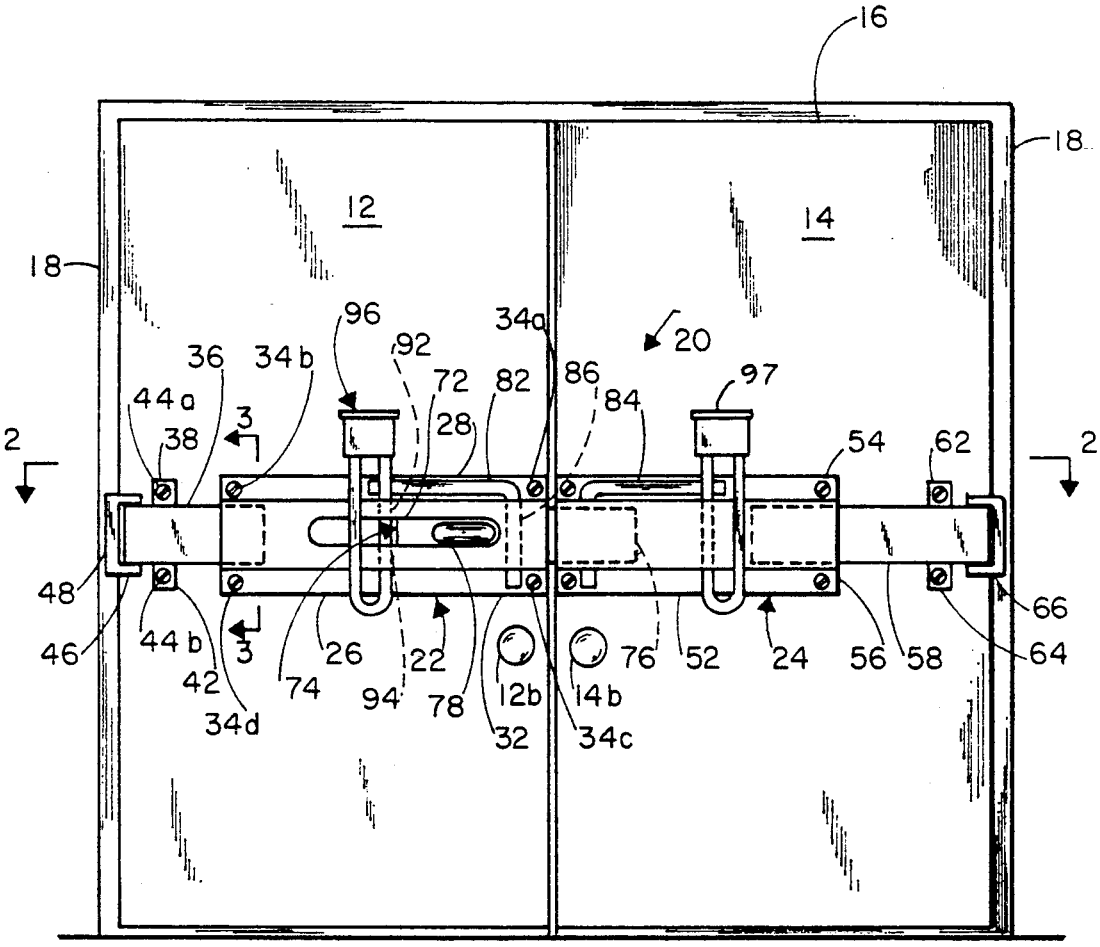
FIG. 1 is a front, elevational view showing a preferred embodiment of the door locking mechanism of the present invention installed on the inside of a pair of outswinging doors mounted in a doorway not having a mullion.
Figure 2:
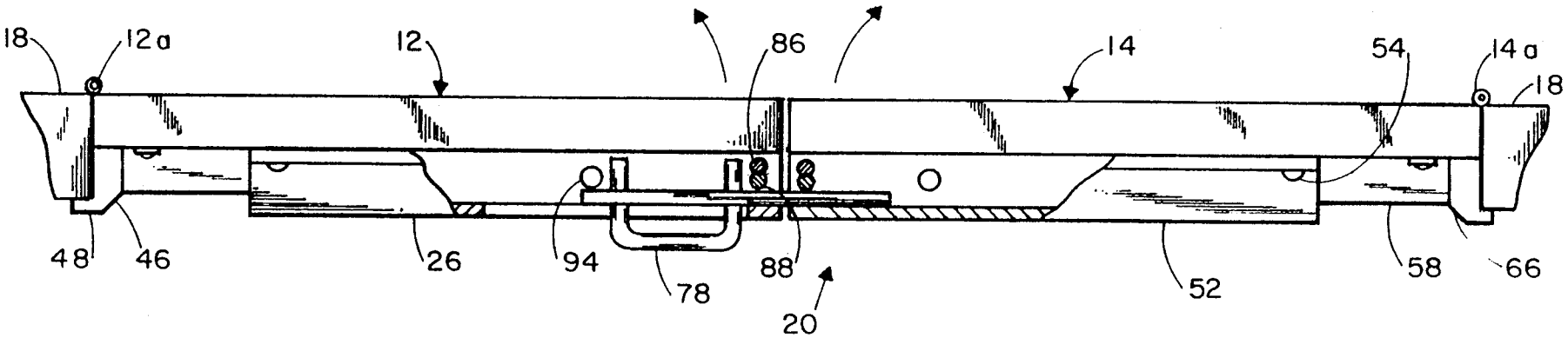
FIG. 2 is a view taken along 2—2 of FIG. 1 and partially broken away.
Figure 10:
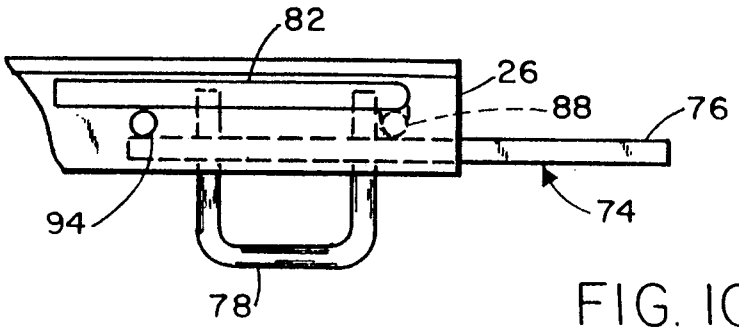
FIG. 10 is a view similar to that of FIG. 2 showing a detail of the latch clamped in place by the lever arm.
Figure 3:
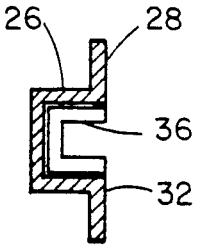
FIG. 3 is a section view taken along 3—3 of FIG. 1.

Referring to FIGS. 1 and 2 there is shown a pair of doors 12 and 14 mounted in an opening 16 and hung by hinges 12*a* and 14*a* from door jamb 18. Doors 12 and 14 are provided with the usual door knobs 12*b* and 14*b* and swing outwardly in the manner illustrated by the arrows in FIG. 2.

Door locking mechanism 20 embodying the principles of this invention is mounted on the inside of doors 12 and 14. Mechanism 20 comprises a pair of assemblies 22 and 24.

Assembly 22 comprises a stationary outer extended member 26 which is U-shaped with flanges 28 and 32 forming a pocket facing door 12. By the use of screws 34*a*, 34*b*, 34*c*, and 34*d*, member 26 is attached to door 12 with the right end flush with the free edge of door 12 as illustrated.

Figure 4:
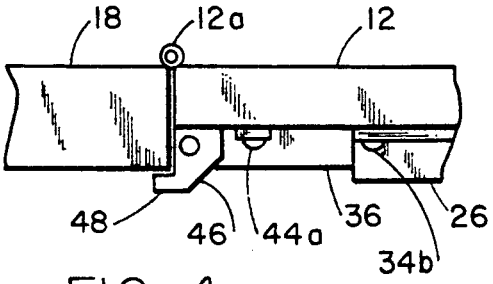
FIG. 4 shows a detail of the left end of door locking system with the door in the closed position.
Figure 5:
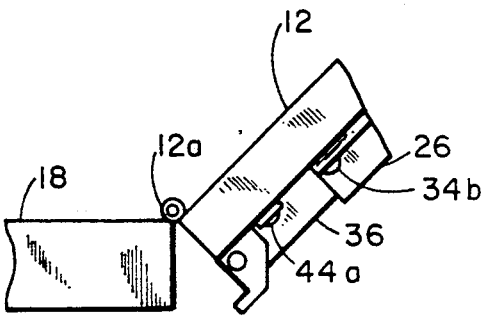
FIG. 5 is a view similar to that of FIG. 3 with the door open.

Within extended member 26 is an inner extended member 36 with a pair of short flanges 38 and 42 attached to door 12 by the use of screws 44*a* and 44*b*. As also seen in FIGS. 4 and 5, the left end of inner member 36 terminating adjacent the edge of the door which is hinged is provided with a bracket 46 with an extended overhang 48 which overlaps door jamb 18.

It can be seen from the construction just described that the length of assembly 22 can be adjusted for a door having any width within a given range. Inner member 36 is moved along its length so that door 12 is fit perfectly as is illustrated in FIG. 1 and then is bolted in place by screws 44*a* and 44*b*.

In a similar fashion assembly 24 consists of a U-shaped outer member 52 with a pair of extended flanges 54 and 56 attached to door 14 in the same manner as member 26.

Within member 52 is an extended inner member 58 attached by a pair of short flanges 62 and 64 similarly attached to door 14 with the left end of outer member 52 flush with the free edge of door 14 and the right end of inner member 58 flush with the hinged edge of door 14 and with a bracket 66 mounted on inner member 58 overhanging door jamb 18. The purpose of brackets 48 and 66 is to prevent removal of doors 12 and 14 from the outside by taking off hinges 12*a* and 14*a*.

In FIGS. 4 and 5 it is illustrated how bracket 46 clears door jamb 18 when door 12 is opened. In a similar manner, bracket 66 mounted on member 58 clears door jamb 18.

Figure 6:
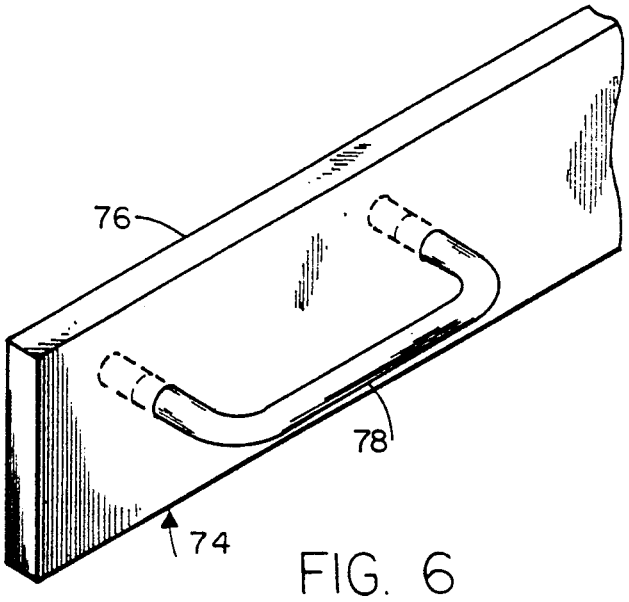
FIG. 6 is an isometric view of the latch.

As seen in FIG. 1, outer member 26 is provided with an extended slot 72. Within outer member 26 is also a slidable latch 74 consisting, as also shown in FIG. 6, of an extended flat plate 76 and a U-shaped handle 78 extending therefrom and out through slot 72. Latch 74 is slidable between a closed position shown in FIG. 1 where handle 78 is at the right end of slot 72 and the right end of plate 76 extends past the free edges of doors 12 and 14 and into outer member 52 mounted on door 14, thereby preventing either door 12 or 14 from being opened.

Figure 7:
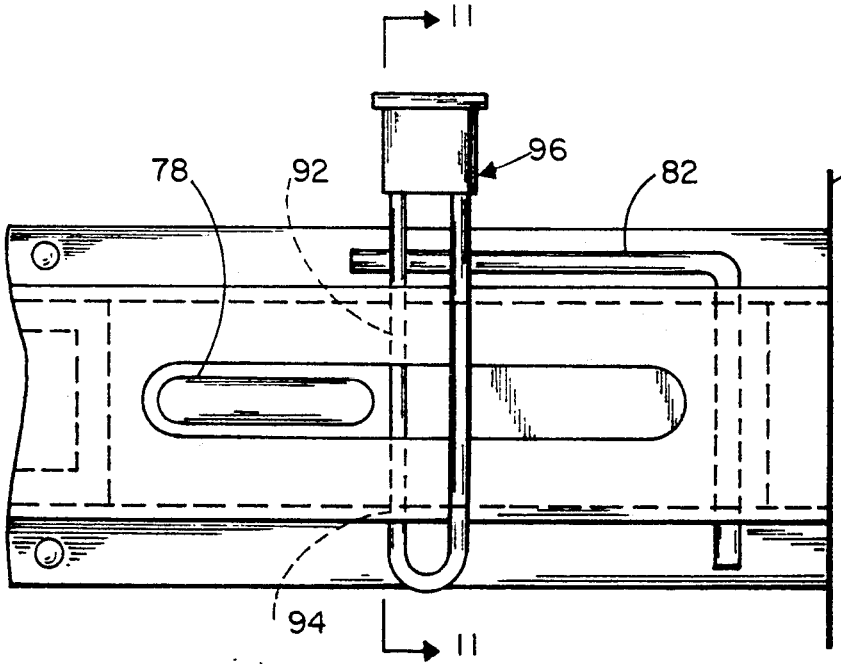
FIG. 7 is a view similar to that of FIG. 1 showing a portion of the locking mechanism with the latch in the open position.

In the open position of latch 74, handle 78 is at the left end of slot 72, as seen in FIG. 7, In order to permit latch 74 to be mounted within locking assembly 20 loosely to permit it to be moved easily between its two positions and yet have it firmly secured against rattling when in either the open or locked positions, there are provided a pair of lever arms 82 and 84 for this purpose.

Figure 8:
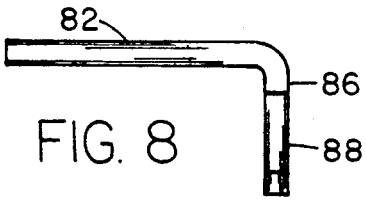
FIG. 8 is a plan view of a lever arm in the position illustrated in FIG. 1.
Figure 9:
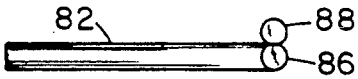
FIG. 9 is an end view of the lever arm shown in FIG. 8.

As seen in FIGS. 8 and 9, lever arm 82 is L-shaped with the leg 86 which extends through outer member 26 being provided with a cam member 88 located under latch plate 76. When lever arm 82 is in the position shown in FIG. 1, cam member 88 presses latch plate 76 up against the top of outer member 26. To release latch 74 for movement, lever arm 82 shown in FIG. 1 is raised thereby rotating leg 86 by 90 degrees, resulting in cam member 88 being rotated out of the way releasing latch plate 76

In a similar fashion, lever arm 84 having the same construction as lever arm 82 would be employed to clamp the right end of latch plate 76.

In this invention it is possible to lock the position of latch 74 in both the open and closed positions.

Figure 11:
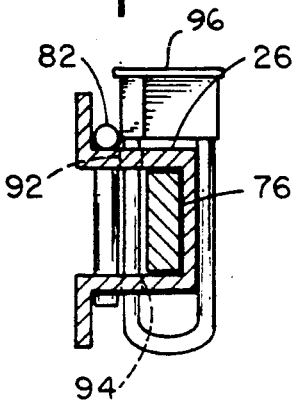
FIG. 11 is a section view taken along 11—11 of FIG. 7.

To accomplish this, outer member 26 is provided with a pair of aligned holes 92 and 94 located in the side walls making up its U-shape as seen in FIG. 11. A lock 96 of suitable construction is inserted as illustrated through holes 92 and 94 which prevents not only the movement of latch 74 but also the rotation of lever arm 82 thereby even preventing the loosening of latch 74 in place.

In a similar manner, a lock 97 is provided for outer member 52 on door 14 to keep lever arm 84 in place when latch plate 76 is in the unlocked position, and to clamp latch plate 76 in plaee when in the locked position.

As seen in both FIGS. 1 and 7, latch 74 can be locked in both the open and closed positions by lock 96 because when latch 74 is in the open position handle 78 is on the other side of lock 74 passing through holes 92 and 94.

In the use of locking mechanism 20 just described, to permit the opening of doors 12 and 14, locks 96 and 97 in FIG. 1 would be opened using a key (although as understood in the art a combination lock may be employed) and lock 96 and 97 removed. Then lever arms 82 and 84 would be raised to release latch 74 which would then be moved to the left so that latch plate 76 would be entirely located along door 12. Lever arms 82 and 84 would then be rotated to the flush positions shown in FIGS. 1 and 7 clamping latch 74 in place. If it were desired to lock mechanism 20 in the open position which would be desired to prevent someone from moving it into the closed position, then lock 96 would be inserted once again through the same holes and closed.

It is thus seen there has been provided a unique door locking mechanism suitable for use on the inside of outswinging double doors.

While only a certain preferred embodiment of this invention has been described it is understood that many variations are possible without departing from the principles of this invention as defined in the claims which follows.

What is claimed is:

1. A door locking mechanism for use on a pair of outswinging doors mounted in an opening formed by a frame in which said doors are hinged at opposite edges thereof and having free edges adjacent each other and free to be moved between an open and closed position, said mechanism comprising a first extended member U-shaped in cross section having a pocket facing the first of said doors and having a flange for attaching said first member to the aforesaid first door, said first member extending horizontally with one end terminating substantially flush with the free edge of said first door and permitting the free edge of the second door to move, latching means mounted for sliding movement within said pocket of said first member, said latching means being provided with a handle, said first member having a slot to permit said handle to pass through said slot and extend out of said first member whereby said handle can be employed to move said latching means within said pocket, said slot being of sufficient length to permit said latching means to be moved between a closed position wherein said latching means extends past the free edges of said doors to overlap said second door and an open position where said latching means is positioned so as not to interfere with movement of said second door, first lever means mounted in said first member rotatable between a first position clamping said latching means against said member and a second position releasing said latching means for free movement within said pocket, an opening passing through said first U-shaped member located so that when said latching means is in its closed position said handle is located within said slot between said opening and the free edge of said first door, and when said latching means is in its open position said handle is located on the other side of said opening, locking means for insertion through said opening to lock said latching means in either said open or closed position, a second extended U-shaped member having a pocket mounted on said second door aligned with said first member and having an end flush with the free edge of said second door for receiving said latching means when said latching means is in its closed position, and second lever means being rotatable between a first position clamping said latching means against said second member and a second position unclamping said latching means.

2. The door locking mechanism of claim 1 in which each of said first and second member is provided with a second slidable member in each pocket for attachment to each door for extending the complete width of each door.

3. The door locking mechanism of claim 2 in which each second slidable member is attached to its respective door and is provided with means at the hinged end overlapping the frame for preventing removal of said door should the hinges be removed from said doors.

4. The door locking mechanism of claim 3 in which each lever means comprises an L-shaped member having an arm which lays flat on said first and second members and a leg which passes through its respective first and second member, each leg having thereon a section which presses against said latching means when locked, each said arm being raised to rotate said section away from said latching means to release the latter.

5. The door locking mechanism of claim 4 in which said lock when mounted prevents rotation of the L-shaped member on said first member.

* * * * *